US005108642A

United States Patent [19]

Aszman et al.

[11] Patent Number: 5,108,642

[45] Date of Patent: Apr. 28, 1992

[54] SOLID DETERGENT CLEANING COMPOSITION, AND METHOD OF MANUFACTURING

[75] Inventors: Harry W. Aszman, Englishtown; Charles E. Buck, Caldwell, both of N.J.

[73] Assignee: Colgate-Palmolive Company, Piscataway, N.J.

[21] Appl. No.: 500,427

[22] Filed: Mar. 28, 1990

Related U.S. Application Data

[62] Division of Ser. No. 925,769, Oct. 30, 1986, Pat. No. 4,935,138.

[51] Int. Cl.[5] ..... C11D 7/54; C11D 3/395

[52] U.S. Cl. ..... 252/95; 252/94; 252/100; 252/103; 252/145; 252/160; 252/558; 252/DIG. 16

[58] Field of Search ..... 252/91, 95, 136, 137, 252/142, 539, 558, 174.21, 174.22, DIG. 16, 160; 15/104.93, 104.94, 209 B

[56] References Cited

U.S. PATENT DOCUMENTS

| | | | |
|---|---|---|---|
| 3,178,370 | 4/1965 | Okenfuss | 252/137 |
| 3,661,787 | 5/1972 | Brown, Jr. | 252/109 |
| 3,816,318 | 6/1974 | Hentschel | 252/174.19 |

*Primary Examiner*—Prince Willis, Jr.
*Assistant Examiner*—John F. McNally
*Attorney, Agent, or Firm*—Richard J. Ancel; Robert C. Sullivan

[57] ABSTRACT

A solid detergent composition for cleaning hard surfaces comprises an active detergent constituent which also serves as a carrier material, and a cleaning constituent. The cleaning constituent can comprise an acidic material, which is effective to remove soap scum from hard surfaces, or a bleach functional at a basic pH which is effective to bleach mildew. The detergent constituent comprises the essentially anhydrous neutralization product of an anionic surfactant such as a linear alkylbenzene sulfonic acid and a solid neutralizing material, such as a salt, oxide, or hydroxide of an alkali or alkaline earth metal, including sodium carbonate. The cleaning constituent, along with a filler material, is added to the detergent constituent during the course of and prior to the termination of the neutralization reaction. Also disclosed is a reusable scrubber pad incorporating the solid detergent composition. Within other aspects of the invention are solid, acidic cleaning compositions containing at least one polycarboxylic acid, solid cleaning compositions containing a bleach functional at a basic pH, and methods for manufacturing and using both the acid pH and the basic pH solid cleaning compositions.

31 Claims, 6 Drawing Sheets

DISSOLUTION RATES x SPREAD PRODUCT WITH SLOPE .0629
* DISC PRODUCT WITH SLOPE

X-PARTIALLY NEUTRALIZED FORMULA .3975
* POWDERED FORMULA .706

SOLID DETERGENT CLEANING COMPOSITION, AND METHOD OF MANUFACTURING

This is a Division, of application Ser. No. 06/925,769 filed Oct. 30, 1986 now U.S. Pat. No. 4,935,158.

BACKGROUND OF THE INVENTION

The present invention relates to solid detergent compositions which are capable of multiple release of active ingredients and which are incorporated into cleaning pads having an abrasive layer that may be disposed of after several uses. Such cleaning pads may contain solid acidic detergent compositions which are particularly useful for cleaning a variety of surfaces, including bathroom fixtures, ceramic tiles, plastic and fiberglass shower stalls, etc. to remove soap scum from them, essentially without damaging any group that may be present between tiles. The abrasive layer will be effective to also remove (by mechanical action) any mildew present. However, other such pads may contain solid detergent compositions which are basic in pH and contain a bleach, which pads are useful in bleaching mildew from the group between tiles.

SUMMARY OF THE INVENTION

This application relates to detergent compositions. More particularly, it relates to solid detergent compositions which are contained in scrubbing pads and are useful for cleaning hard surfaces, especially for cleaning bathroom fixtures and surfaces to remove soap scum and mildew from them. They are also effective for cleaning soft surfaces, such as shower curtains.

The problem of cleaning soap scum from bathroom surfaces, such as sinks, tubs, shower walls and floors, is one that is well known to every householder. Soap scum which contains water insoluble calcium and magnesium soaps, produced by the reactions of hard water on soluble sodium soaps, causes dulling and streaking of tile and other hard surfaces, which are normally and desirably attractively lustrous and shiny. Such soap scum is usually strongly adherent to the substrate and is difficult to remove with the aid of conventional cleaning materials.

It is known that acids and acidic preparations help to remove soap scum from a variety of surfaces, and acidic cleansers have been made, patented and marketed. Synthetic detergents have been used in such cleansers, and solvents have also been employed in them. The solid form of such cleansers is known, but a drawback thereof is that they are considered inconvenient to use. The liquid form of such cleaners is often preferred thereto, and water is often the carrier or solvent of choice. However, consumers find that such liquid cleaners tend to drip down the wall being cleaned. Thus, while the problem of adequately and easily removing soap scum from a surface has been known for a long time, and water, detergents, acidifying agents and solvents have been suggested for inclusion in tile cleaning compositions, before the present invention, solid multiple release, cleaning compositions incorporated in scrubber pads were not available for effectively cleaning bathroom surfaces and the like. Copending application Ser. No. 861,904, assigned to the assignee of the present invention, discloses a cleaning pad containing a liquid detergent, which pad is designed for a single use.

According to one aspect of the present invention, an active detergent constituent is provided, which constituent also serves as a carrier for a cleaning constituent—either an acidic pH constituent when it is desired to remove soap scum (and mildew) or a constituent basic in pH that contains a bleach, when it is desired to bleach mildew. This detergent constituent comprises the reaction product of the essentially anhydrous or nonaqueous neutralization reaction between a linear alkyl benzene sulfonic acid and a solid alkali or alkaline earth metal salt, which reaction results in the formation of a solid linear alkylbenzene sulfonate salt. Thus, the active detergent constituent serves both as a surface active agent in the final detergent composition and as a carrier for other active ingredients, provided the other active ingredients are mixed with the detergent constituent during the course of, but before the completion of, the neutralization reaction.

According to another aspect of the present invention, a multiple use scrubber pad effective to remove soap scum and mildew is provided, in which an acidic pH constituent is added to the active detergent constituent, along with a filler constituent, to provide an acidic solid detergent composition that, when incorporated with the scrubber pad to be described below, is useful in removing soap scum and mildew from hard surfaces.

According to yet another aspect of the present invention, scrubber pads useful in bleaching and removing mildew are provided. Such pads incorporate a cleaning composition that comprises a bleach that is functional in an alkaline pH environment that is added to the active detergent constituent during the course of, and prior to completion of, the neutralization reaction.

Still another aspect of this invention relates to a multiple use scrubber pad construction employing the detergent compositions of this invention. Such pads preferably comprise a scrubber layer, a first padding layer attached to a rear surface thereof, a solid form of an active detergent composition (acidic or basic) applied as a paste to the front face of a second padding layer, which layer is attached to a rear surface of the first padding layer, and a plastic cover sheet covering the rear surface of the second padding layer, the layers heat sealed together at their peripheral edges to form a unitary pad.

Further features will become fully apparent in the following description of the embodiments of this invention and from the appended claims.

DETAILED DESCRIPTION OF THE PREFERRED EMBODIMENTS

Figure 1:
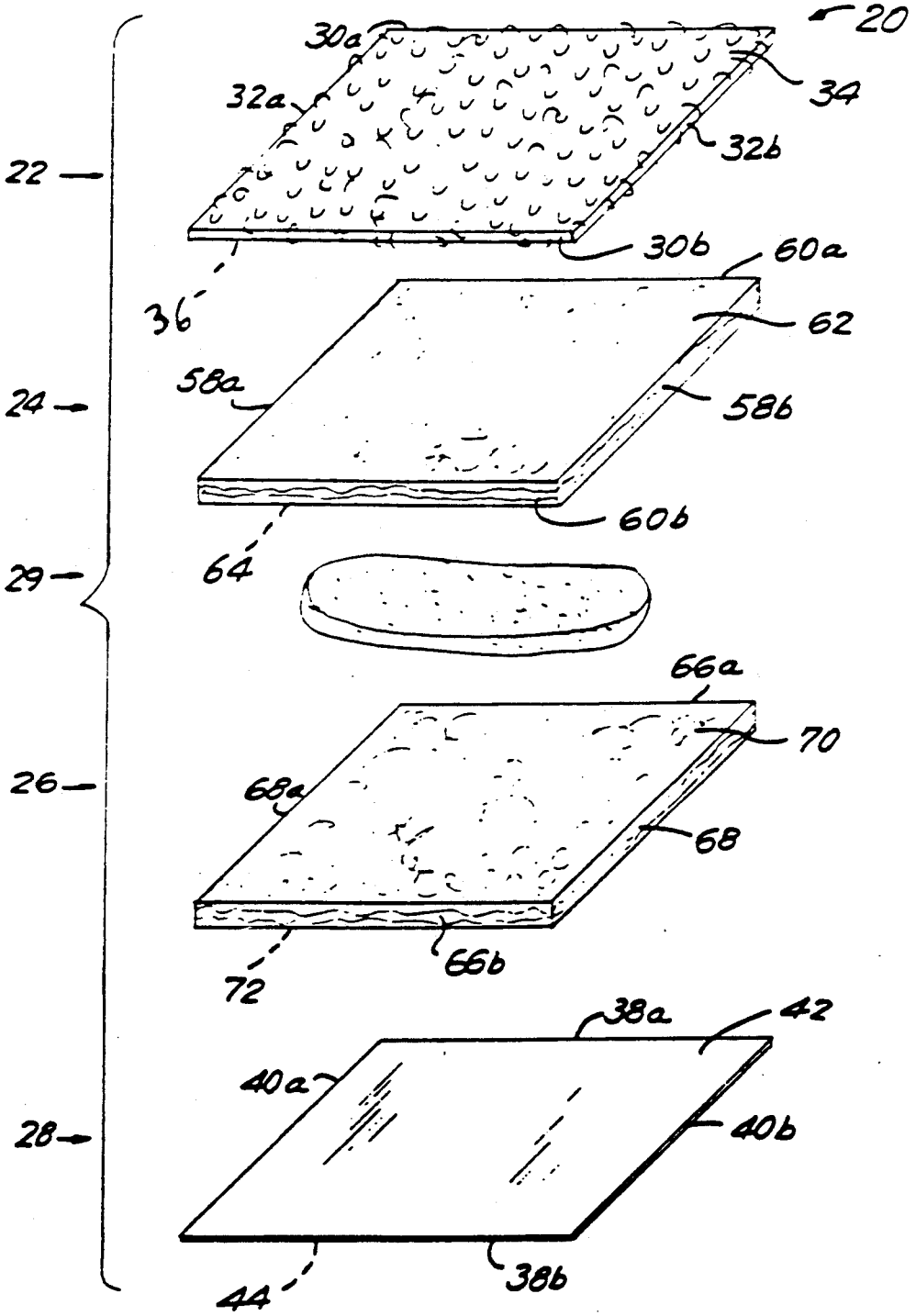
FIG. 1 is an exploded perspective view of the preferred embodiment of a scrubber pad according to the present invention.
Figure 2:
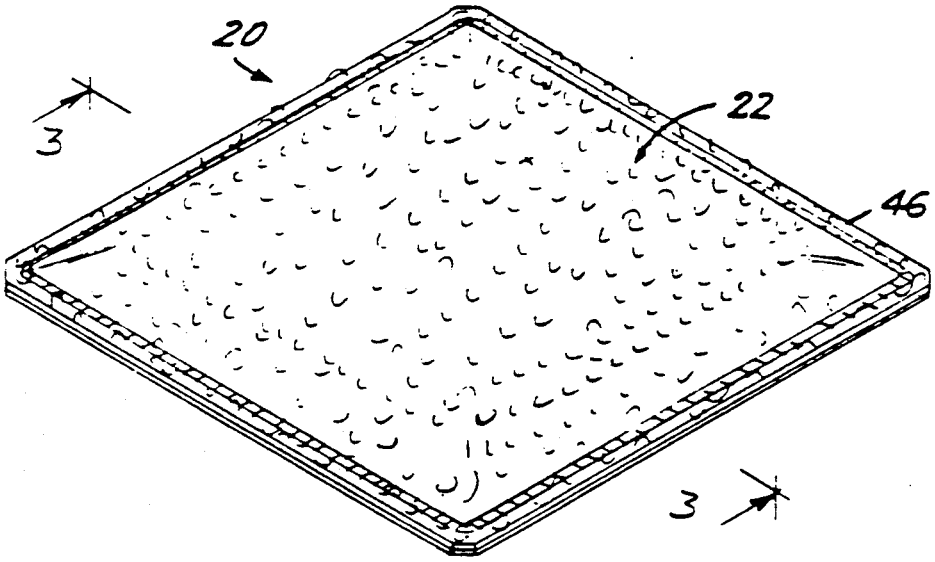
FIG. 2 is a perspective view of an assembled pad.
Figure 3:
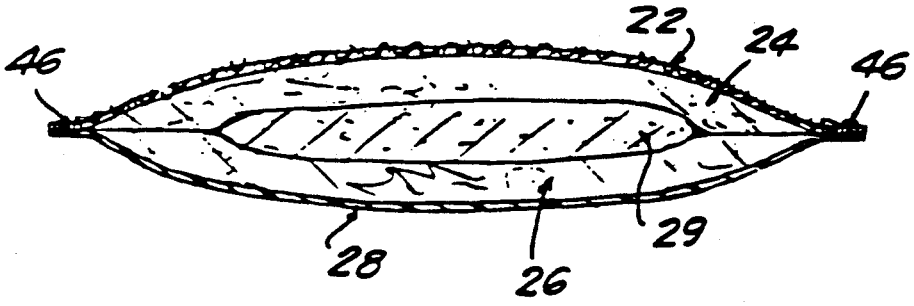
FIG. 3 is a cross-sectional view of the assembled pad taken along the lines 3—3 of FIG. 2.

Referring now to FIGS. 1-3, there is shown a cleaning pad generally designated 20 of the present invention. The pad 20 has a scrubber layer 22, a first padding layer 24, a second padding layer 26 on the opposite face of padding layer 24, a liquid impervious sheet 28 on the opposite face of padding layer 26, and a solid detergent composition 29 intermediate the first and second padding layers 24 and 26.

The scrubber layer 22 has a pair of opposed side edges 30*a* and 30*b*, and a pair of opposed end edges 32*a* and 32*b* connecting the side edges 30*a* and *b*. The scrubber layer 22 has a front surface 34 for contacting a soiled surface, and a rear surface 36 facing the first padding layer 24. The scrubber layer 22 is preferably constructed from a nonwoven material which slides easily across hard surfaces to be cleaned. The scrubber layer 22 has a coarse texture and resiliency when compared with conventional devices, such as sponges.

The scrubber layer 22 is compatible with the surfaces to be cleaned, and is free of hard fibers or binders in the nonwoven fabric which could scratch the surfaces. The scrubber layer 22 has an open web structure such that it is porous for particulate soil entrapment during scrubbing. The scrubber layer 22 is flexible to provide excellent recovery from creasing. The scrubber layer 22 also provides for excellent liquid spreadability.

One example of a material for the scrubber layer 22 is a spun bonded nonwoven material sold under the Code No. 6952801 by Union Wadding of Pawtucket, Rhode Island. The specifications for this material have proven to be safe and effective in cleaning soiled textured surfaces: 15 and 25 denier 100% polyester fibers bonded with 30% by weight polyvinyl chloride and a basis weight of 5.5 oz./sq.yd. The porous nature of this material captures particulate material. A further example of the scrubber layer 22 is a nonwoven material made by The Kendall Company, Boston, Mass., and identified as Bristle-tex, such as the fabric disclosed in U.S. Pat. No. 4,537,819, incorporated herein by reference. This nonwoven material is a composite structure of polyurethane foam and hydroentangled fibers. The material is a reticulated polyurethane foam containing 10 to 15 pores/inch hydroentangled with a fiber blend of 50%/50% polyester/rayon. This composite structure produces a whisker or bristle effect which penetrates deep into embossed areas or valleys of the surfaces to be cleaned. Other examples of materials useful as the scrubber layer 22 are flocked foams with a heavy denier fiber flocked into a foam substrate, the polyurethane foam referred to in U.S. Pat. No. 4,537,819, and bristle composites. In a preferred form, the scrubber layer has a basis weight of 2 to 6 oz./sq.yd. and a thickness in the range of 0.125 to 1.0 inches. The thickness of the scrubber layer 22 is an important factor in cleaning performance and ease of usage.

The first padding layer 24 has a pair of opposed side edges 58*a* and 58*b*, a pair of opposed end edges 60*a* and 60*b* connecting the side edges 58*a* and *b*, a front surface 62 for contacting the surface of the scrubber layer 22, and a rear surface 64 facing the impervious sheet 28.

Similarly, the second padding layer 26 has a pair of opposed side edges 66*a* and 66*b*, a pair of opposed end edges 68*a* and 68*b* connecting the side edges 68*a* and 68*b*, a front surface 70 facing the rear surface 64 of the first padding layer 24 and a rear surface 72 facing the sheet 28.

Solid detergent composition 29 is disposed intermediate padding layers 24 and 26, and it will be discussed in detail below.

The liquid impervious sheet 28 has a pair of opposed side edges 38*a* and 38*b*,*a* pair of opposed and edges 40*a* and 40*b* connecting the side edges 38*a* and 38*b*, a front surface 42 facing the scrubber layer 22, and a rear surface 44. The sheet 28 prevents the fingers of the user from getting wet or from coming into contact with the active ingredients while utilizing the scrubber pad 20. The sheet 28 also aids in providing structural integrity and body to the pad 20. When scrubbing, the film 28 facilitates sliding of the pad 20. The sheet 28 is preferably constructed from a thermoplastic material, such as low density polyethylene, such that it may be heat sealed to the scrubber layer 22 and padding layers 24, 26 in regions 46. Alternatively, a suitable adhesive may be utilized to bond the sheet 28 to the scrubber layer 22 and padding layers 24, 26. The sheet 28 is constructed from a material which is not too rigid to prevent sharp, rigid edges which might otherwise scratch the soiled surface or cut the user. Other suitable materials include latex rubber and liquid impervious nonwoven fabrics. In a preferred form, the sheet 28 is 4 mils thick or greater, and it is preferably textured as by embossing, so that it may be gripped easily by the user.

Figure 4:
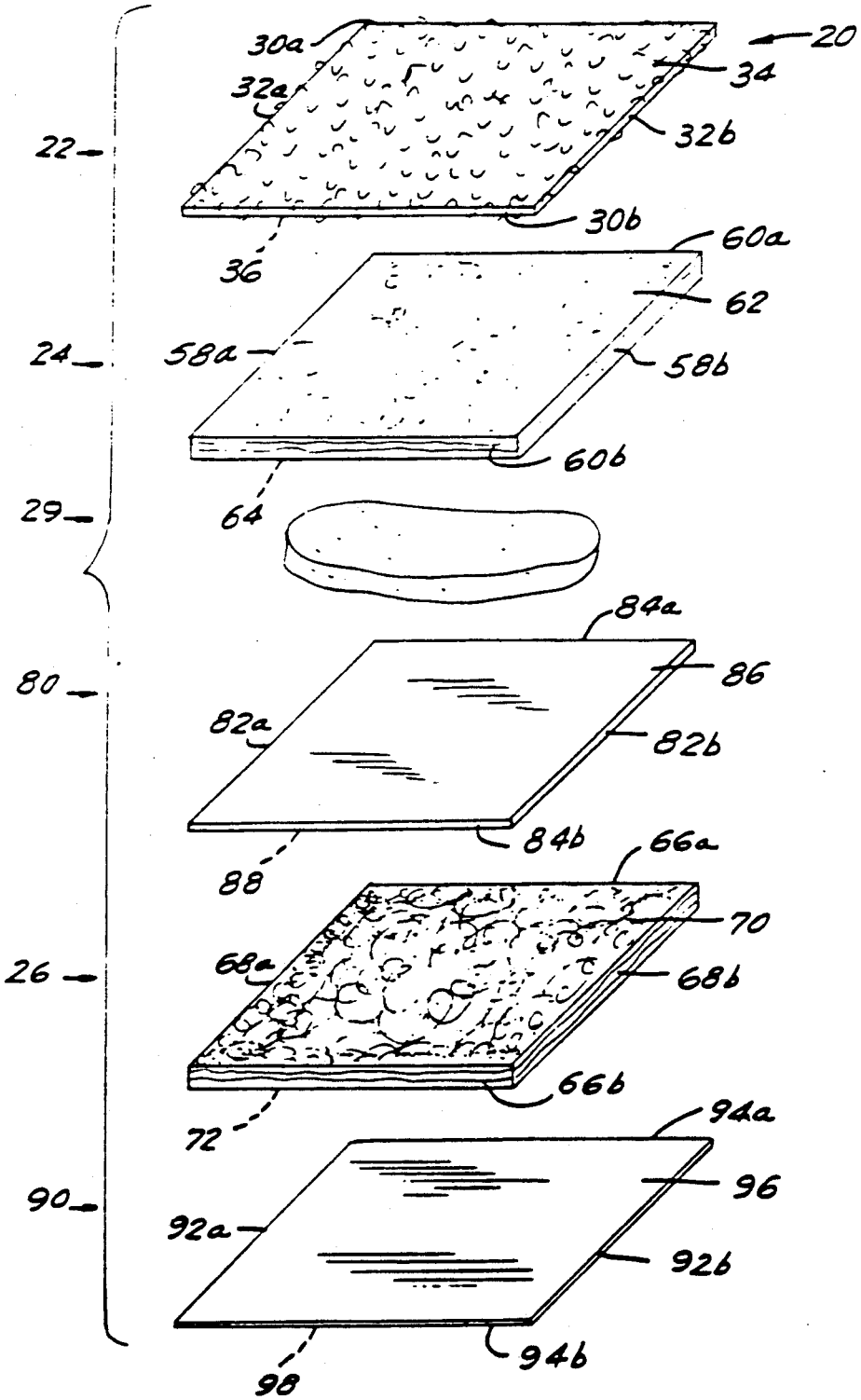
FIG. 4 is an exploded perspective view of an alternative embodiment of a scrubber pad according to the present invention.

An alternative form of a scrubber pad is illustrated in FIG. 4, in which like reference numerals designate like parts. In this embodiment, scrubber layer 22 is in contact with first padding layer 24. Solid detergent composition 29, which will be discussed below, is located between the rear surface 64 of first padding layer 24 and the top surface 86 of impervious layer 80, the rear surface 88 of which is in contact with the top surface of second padding layer 26, which, in turn, is in contact with a backing sheet layer 90.

It should be recognized, however, that the only layers necessary to form a scrubbing pad are the scrubber layer, and the backing layer or impervious sheet, which are illustrated in FIGS. 1-3 as numerals 22 and 28 respectively, with the solid detergent composition 29 disposed therebetween. First and second padding layers 24 and 26, which are thus optional, may comprise airlaid nonwoven fabrics or cellulose sponges, and they are utilized in the pad to provide body thereto. Union Wadding comprises a useful padding layer.

It should also be recognized that handles (not illustrated) can be affixed to the rear surfaces of the scrubber pads if desired. Also, the scrubber pads can be affixed to a mop head. In this connection, reference is made to copending application Ser. No. 861,904, especially FIGS. 8-10 and the discussion thereof.

SOLID DETERGENT COMPOSITION

The solid detergent composition 29 is made by reacting, in a non-aqueous or essentially anhydrous environment, a linear or branched alkyl aryl sulfonic acid with a solid, particulate neutralizing agent. As the neutralization reaction proceeds, but prior to its completion, an active cleaning constituent selected from the group consisting of organic acids and alkaline pH functional bleaches is thoroughly admixed with the partially neutralized sulfonic acid, which initially is in the form of a slurry and subsequently takes the form of a pasty solid.

During the slurry stage, other ingredients can also be added including fillers, perfumes, solvents, process aids and the like. Upon cooling and aging, this pasty mixture hardens into a solid. This mixture may be applied directly to a layer of the scrubber pad in the form of a spread or in another geometric form or in the form of a disc, where it will initially harden to its final consistency.

Surprisingly, it has been discovered that the addition of cleaning constituents to the slurry containing the partially neutralized alkyl aryl sulfonic acid during the course of but prior to the termination of the essentially anhydrous neutralization reaction is responsible for the slow or timed release of the active cleaning constituents, which prolongs the useful life of the scrubber pad by permitting multiple reuses before discarding of same is necessary.

In general, the acid formulation of the solid detergent composition comprises: a) from about 12–40% by weight of an anionic detergent surfactant which comprises an alkali or alkaline earth metal salt of an alkyl aryl sulfonate, wherein the alkyl group contains from about 10–22 carbon atoms, and the aryl group is benzene; b) from about 2–30% of a solid neutralizing agent, which comprises a salt, oxide, or hydroxide of an alkali metal or alkaline earth metal; c) from about 1–50% of an organic acid constituent which provides effective buffering at a pH range of between 2.5 and 5.5, with the pH range of 4–4.5 being preferred. Suitable acids include the polycarboxylic, especially solid dibasic and dicarboxylic acids; e) from about 0–70% of a filler material, sodium sulfate being preferred; and f) the balance of other minor ingredients including perfumes (about 1%), solvents (about 0–3%), and process aids.

The alkaline-pH functional bleach formulation of the solid detergent composition is similar to the above acid formulation with the following exceptions: i) the acid constituent c) is replaced by an effective amount of an alkaline pH effective bleach, such as Oxone or trichlorocyanuric acid (TCCA), which is a chlorine bleach; and ii) adjustments may be made in the amount of the neutralizing agent and/or acid present to ensure a pH range of 7–11, but an optimum pH is in the range of 7.5–8.5 for the solid detergent composition.

Among the effective alkyl aryl sulfonic acids are those having about 10–22 carbon atoms in the alkyl group. Preferred are the higher linear alkyl benzene sulfonic acids, with linear dodecylbenzene sulfonic acid (LDBS) constituting the preferred sulfonic acid.

Among the suitable solid neutralizing agents are the salts (carbonates and bicarbonates preferred), oxides, and hydroxides of alkali metals (sodium and potassium preferred) and alkaline earth metals (calcium and magnesium preferred). Advantageously there is present an amount of neutralizing agent at least equal to the amount stoichiometrically necessary for the essentially complete neutralization of the detergent acid (in the acid formulation). In the alkaline pH bleach formulation, an excess will be present (along with an acid, if necessary) to result in a final pH in the range of 7.5–8.5.

Among the suitable organic polybasic acid constituents are the dibasic or dicarboxylic acids, such as glutaric, oxalic, succinic, adipic, tartaric, and mixtures thereof. Citric acid, a tricarboxylic acid, may also be used. A preferred acid constituent is DBA (dibasic acids) available from E. I. Du Pont DeNemours & Co. Inc. , which comprises approximately 55% glutaric acid, 26% succinic acid, 18% adipic acid and 0.3% nitric acid. DBA provides an effective pH range which permits the easy removal of soap scum, and it is available commercially at a lower price than individual dicarboxylic acids.

As previously mentioned, the pH of the acid formulation of the solid detergent composition should be kept within the range of pH 2.5–5.5, with the range of 4–4.5 being preferred.

Among the suitable bleaches that function at alkaline pH's are: a) Oxone, which is an oxygen bleach supplied by Du Pont, the active ingredient of which is potassium monopersulfate and it is comprised of two moles of potassium monopersulfate, one mole of potassium hydrogen sulfate and one mole of potassium sulfate; and b) trichlorocyanuric acid, a chlorine bleach. As will be shown in Table VI, glutaric acid, citric acid, and excess sodium carbonate may be employed with the bleach formulations as process aids. Excess sodium carbonate is added to speed up the neutralization reaction and thereby to speed up the hardening of the solid detergent composition. The glutaric or citric acid is used to neutralize the excess sodium carbonate to maintain a pH of about 8.

The following examples are given to illustrate the nature of the invention, but it will be understood that the invention is not limited thereto. In these examples, as in the remainder of the specification and claims, proportions are indicated by weight unless otherwise specified. Also, certain formulations may not add up to 100% due to exclusion of perfumes, solvents, process aids and the like. Table I provides nine examples of various organic acid detergent formulations. Table II provides three examples of different neutralizing agents that may be used to neutralize the alkyl benzene sulfonic acid. Table III provides three examples that illustrate acceptable variations in the amount of sodium carbonate that may be used as a neutralizing agent. It should be recognized that sodium carbonate in excess of the stoichiometric amount necessary to neutralize the alkyl benzene sulfonic acid may be present to speed up the neutralization reaction and hence to speed up the hardening of the detergent composition. In such instances, the amount of the organic acid constituent may be increased to result in a pH at the desired acid level, a pH range of 4–4.5 being preferred. Table IV provides four examples illustrating variations in the amount of sodium sulfate filler. Example 16, however, illustrates a formulation in which water replaced the sodium sulfate filler. The resultant material dissolved too quickly and remained too soft to be of commercial value. This example illustrates the need for the neutralization reaction and the addition of the auxiliary materials to be carried out in an essentially anhydrous or non-aqueous environment. Table V provides four examples illustrating variations in the amount of the alkyl benzene sulfonic acid constituent in the bleach-containing detergent compositions. Table VI provides three examples of varying process aids for the alkaline pH bleach containing formulations. For example, sodium carbonate in excess of he stoichiometric amount necessary to neutralize the alkyl benzene sulfonic acid may be present to speed up the neutralization reaction and hence to speed up the hardening of the detergent composition. Citric acid or glutaric acid may also be present to neutralize the excess sodium carbonate to maintain a pH at the desired alkaline level, a pH range of 7.5–8.5 being preferred. Table VII provides four examples of different bleaches (Oxone—with sodium percarbonate present as an activator—and TCCA).

TABLE 1

VARIATION OF ORGANIC ACIDS IN ACID FORMULATIONS

| COMPONENT | EX. 1 | EX. 2 | EX. 3 | EX. 4 | EX. 5 | EX. 6 | EX. 7 | EX. 8 | EX. 9 |
|---|---|---|---|---|---|---|---|---|---|
| LDBS ACID | 35.1 | 24.6 | 24.6 | 24.6 | 24.6 | 24.6 | 35.1 | 24.6 | 24.6 |
| GLUTARIC ACID | 35.1 | 10.0 | — | — | — | — | — | — | 15.0 |
| OXALIC ACID | — | 4.2 | — | — | — | — | 35.1 | — | 7.3 |
| CITRIC ACID | — | — | 22.3 | — | — | — | — | — | — |
| DBA | — | — | — | 22.3 | — | — | — | 22.3 | — |
| SUCCINIC ACID | — | — | — | — | 22.3 | — | — | — | — |
| TARTARIC ACID | — | — | — | — | — | 22.3 | — | — | — |
| SODIUM CARBONATE | 16.2 | 12.5 | 16.0 | 16.0 | 16.0 | 16.0 | 16.0 | 9.4 | 16.0 |
| SODIUM SULFATE | 10.8 | 47.7 | 37.1 | 37.1 | 37.1 | 37.1 | 10.8 | 42.7 | 36.1 |
| SODIUM STEARATE | 1.4 | — | — | — | — | — | 1.4 | — | — |
| PERFUME | — | — | — | — | — | — | — | 1.0 | 1.0 |

TABLE II

VARIATION OF NEUTRALIZATION AGENTS IN ACID FORMULATIONS

| COMPONENT | EXAMPLE 10 | EXAMPLE 11 | EXAMPLE 12 |
|---|---|---|---|
| LDBS ACID | 35.1 | 35.1 | 35.1 |
| GLUTARIC ACID | 15.0 | 15.0 | 15.0 |
| SODIUM CARBONATE | 10.6 | — | — |
| SODIUM BICARBONATE | — | 10.6 | — |
| SODIUM HYDROXIDE | — | — | 10.6 |
| OXALIC ACID | 6.3 | 6.3 | 6.3 |
| SODIUM STEARATE | 1.4 | 1.4 | 1.4 |
| SODIUM SULFATE | 30.2 | 30.2 | 30.2 |

TABLE III

VARIATION OF CARBONATE IN ACID FORMULATIONS

| COMPONENT | EXAMPLE 13 | EXAMPLE 14 | EXAMPLE 15 |
|---|---|---|---|
| LDBS ACID | 24.6 | 24.6 | 35.1 |

TABLE III-continued

VARIATION OF CARBONATE IN ACID FORMULATIONS

| COMPONENT | EXAMPLE 13 | EXAMPLE 14 | EXAMPLE 15 |
|---|---|---|---|
| GLUTARIC ACID | — | 10.0 | 27.9 |
| OXALIC ACID | — | 4.2 | 11.7 |
| DBA | 22.3 | — | — |
| SODIUM CARBONATE | 9.4 | 7.1 | 19.8 |
| SODIUM SULFATE | 42.6 | 40.9 | — |

TABLE IV

VARIATION OF SULFATE IN ACID FORMULATIONS

| COMPONENT | EXAMPLE 16 | EXAMPLE 17 | EXAMPLE 18 | EXAMPLE 19 |
|---|---|---|---|---|
| WATER | 32.0 | — | — | — |
| LDBS | 26.0 | 24.6 | 26.0 | 32.1 |
| GLUTARIC ACID | 20.0 | 22.3 | 20.0 | 24.7 |
| OXALIC ACID | 6.0 | — | 6.0 | 7.4 |
| SODIUM CARBONATE | 10.5 | 9.4 | 12.0 | 14.8 |
| SODIUM SULFATE | — | 42.6 | 8.0 | 19.7 |

TABLE V

VARIATION OF LDBS ACID IN ALKALINE pH-BLEACH FORMULATIONS

| COMPONENT | EXAMPLE 20 | EXAMPLE 21 | EXAMPLE 22 | EXAMPLE 23 |
|---|---|---|---|---|
| LDBS ACID | 37.0 | 24.6 | 18.5 | 10.0 |
| GLUTARIC ACID | 5.3 | 5.3 | 5.3 | 5.3 |
| SODIUM CARBONATE | 26.3 | 20.0 | 18.0 | 15.0 |
| OXONE ® | 21.0 | 21.0 | 21.0 | 21.0 |
| SODIUM SULFATE | 10.4 | 29.1 | 37.2 | 58.6 |

TABLE VI

VARIATION OF PROCESS AIDS FOR THE ALKALINE pH-BLEACH FORMULATIONS

| COMPONENT | EXAMPLE 24 | EXAMPLE 25 | EXAMPLE 26 |
|---|---|---|---|
| LDBS ACID | 37.0 | 37.0 | 24.6 |
| GLUTARIC ACID | 5.3 | — | — |
| CITRIC ACID | — | — | 6.0 |
| SODIUM CARBONATE | 26.3 | 18.4 | 20.0 |
| SODIUM SULFATE | 10.4 | 34.1 | 28.3 |
| OXONE ® | 21.1 | 10.5 | 21.1 |

TABLE VII

VARIATION OF BLEACHING SYSTEM FOR ALKALINE pH-BLEACH FORMULATIONS

| COMPONENT | EXAMPLE 27 | EXAMPLE 28 | EXAMPLE 29 | EXAMPLE 30 |
|---|---|---|---|---|
| LDBS ACID | 24.6 | 24.6 | 24.6 | 24.6 |
| GLUTARIC ACID | 5.3 | 5.3 | — | 5.3 |
| CITRIC ACID | — | — | 6.0 | — |
| SODIUM CARBONATE | 20.0 | 10.0 | 18.0 | 20.0 |

TABLE VII-continued

| COMPONENT | VARIATION OF BLEACHING SYSTEM FOR ALKALINE pH-BLEACH FORMULATIONS | | | |
|---|---|---|---|---|
| | EXAMPLE 27 | EXAMPLE 28 | EXAMPLE 29 | EXAMPLE 30 |
| OXONE ® | 21.0 | 10.5 | — | 21.1 |
| SODIUM PERCARBONATE* | — | 5.3 | — | — |
| TCCA | — | — | 6.0 | — |
| SODIUM SULFATE | 29.1 | 44.3 | 45.4 | 28.0 |

*an Oxone activator.

PROCESS FOR FORMING SOLID COMPOSITIONS

The solid detergent compositions of this invention are formed by the essentially anhydrous or non-aqueous reaction between an alkyl aryl sulfonic acid, linear dodecyl benzene sulfonic acid (LDBS acid) being preferred, and a solid neutralizing agent, sodium carbonate being suitable, to form a neutralized salt of the sulfonic acid (sodium LDBS), which initially takes the form of a slurry and later has a pasty consistency. As this reaction proceeds, the active cleaning ingredients (the organic acids or alkaline pH functional bleaches) are added to the slurry and thoroughly blended. When pasty in consistency, this mixture is applied directly to a layer of a scrubber pad. Upon cooling and aging, this pasty mixture hardens into a solid, by which time the neutralization reaction has essentially ended, and it is the solid form of the detergent composition that is responsible for the slow release of the active cleaning compounds, which prolongs the life of the scrubber through multiple reuses. For example, scrubber pads incorporating about 20 grams of the composition of Example 8 were found to be effective for 3-6 uses before needing to be discarded.

By "essentially anhydrous reaction" is meant that the neutralization reaction is carried out in a non-aqueous environment. The only water present is that found in the initial reactants (i.e. LDBS acid contains about 2% water as an impurity); no free water is added thereto. Any water so present or formed as a result of the neutralization reaction will be absorbed by the reaction product (which will be lost by subsequent drying) or released as a gas.

Figure 5:
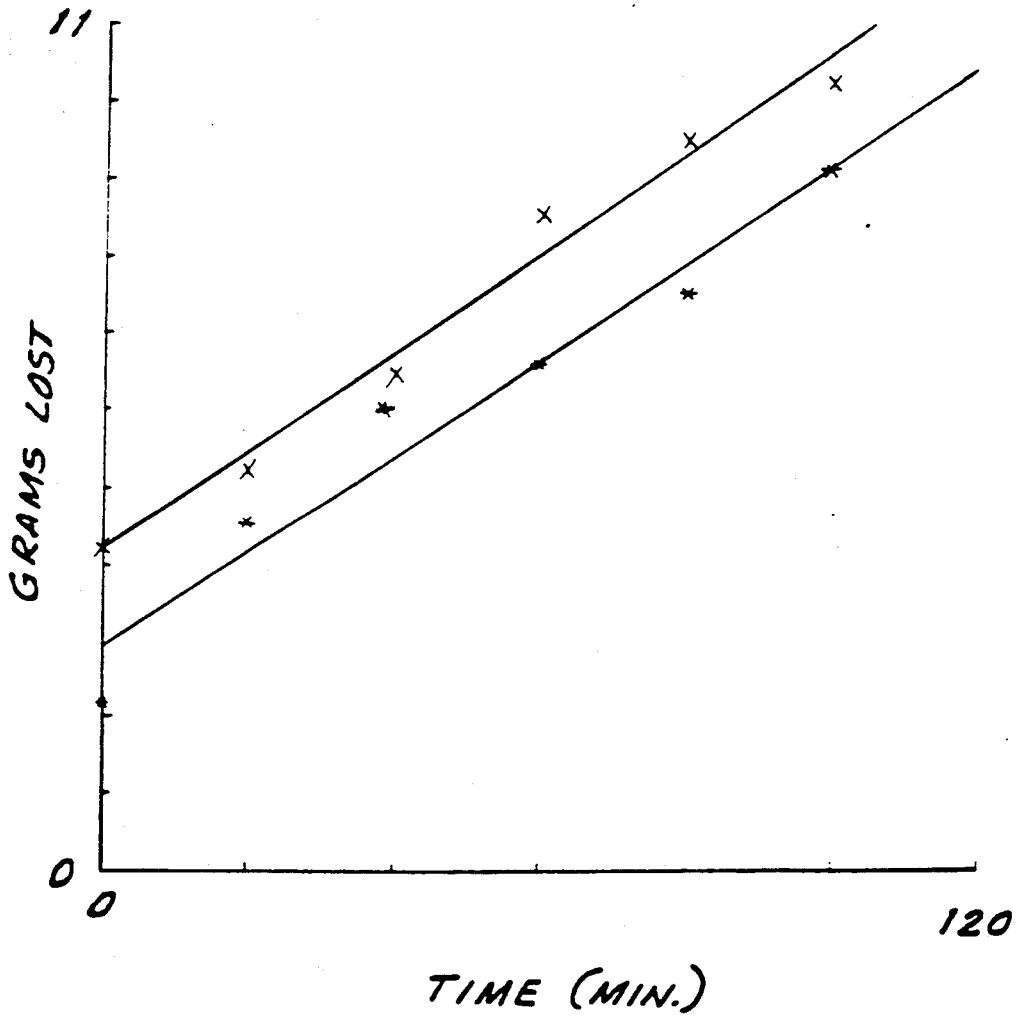
FIG. 5 is a graph illustrating the comparative dissolution rates of a spread versus a disc form of 20 grams of preferred formulation of a solid acid detergent composition.

Also, the pasty detergent composition can be spread directly onto a layer of the scrubber pad and allowed to harden during which time the scrubber pad layers will be sealed together. The composition can remain as a spread or be formed into a variety of geometric forms, i.e. a disc and then applied to the scrubber pad. FIG. 5 is a plot of the dissolution rates of a "spread" form of 20 grams of the solid detergent composition of Example 13 versus the "disk" form. Each curve represents the average of three trials. A dunk tester, which is employed to measure sloughing of soap, was used to measure the relative dissolution rates of the disk form versus the spread form. The test was carried out as follows: A pad containing the composition was affixed to a bar which was then lowered into a bucket of water and allowed to soak ten minutes therein. Thereafter, the bar was reciprocated up and down at a rate of twenty cycles per minute, and tests on the pad were run at twenty minute intervals.

As will be noted, the results showed no significant difference in dissolution rates between the two forms, except in initial values.

The stability of a bleach containing detergent composition (containing Oxone) was determined by measuring the amount of available oxygen (AO) present compared to the amount of Oxone initially employed. The results were that a control disk of the formula of Example 21 had 4.43% AO; a non-used disk had 4.34% AO; and a partially used disk had 4.39% AO. This test was run by making pads containing the formulation of Example 21, using them to clean a sink, and then placing the used pad in a test solution to determine the A.0. Such pad was then discarded and a new one used.

Figure 6:
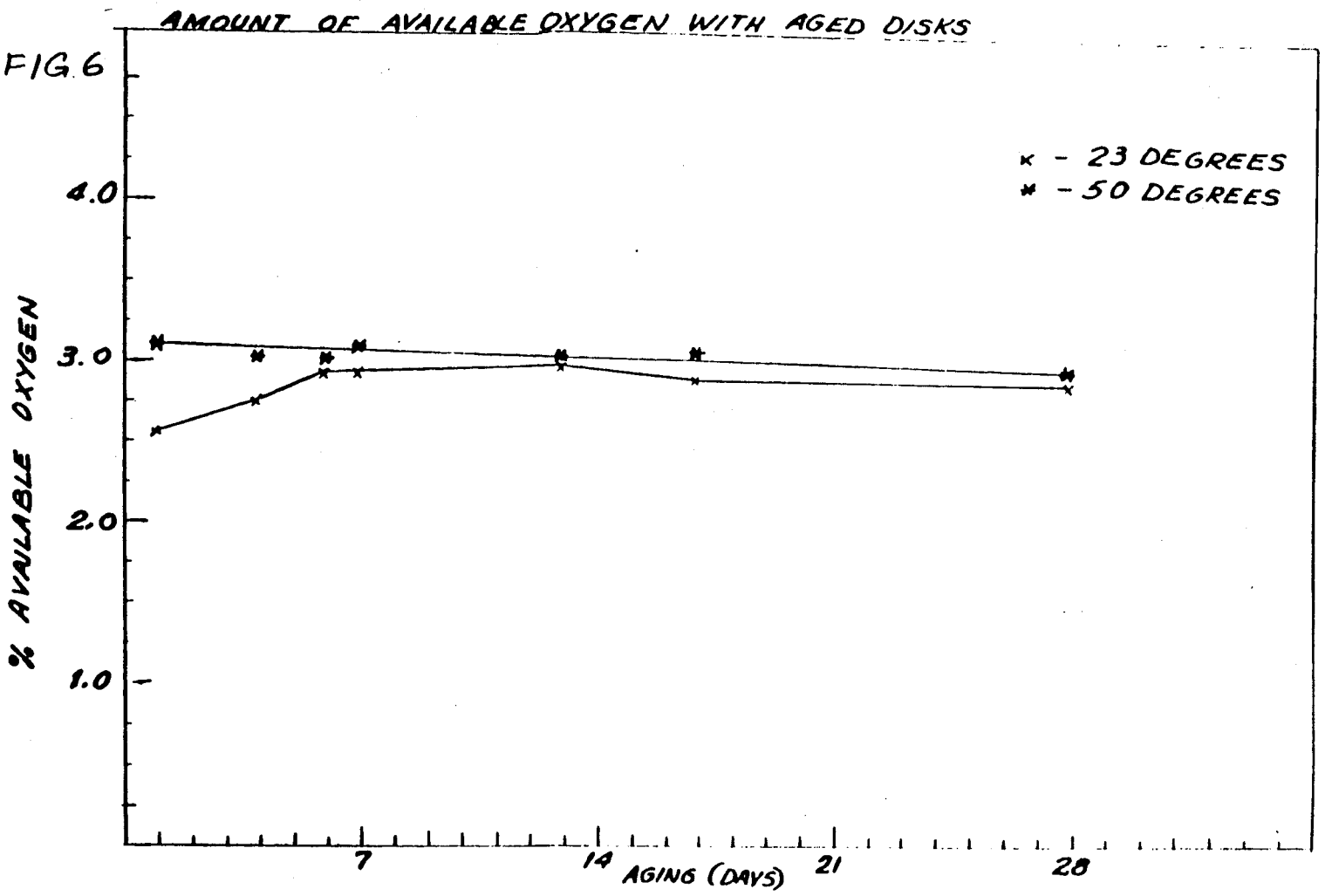
FIG. 6 is a graph illustrating the amount of available oxygen in discs of various ages which incorporate a solid alkaline pH functional bleach detergent composition.

The formulation of Example 21 was prepared at 23 degrees and 50 degrees centigrade. Disks made at 50 degrees were hard as compared to those at 23 degrees and supplied the necessary timed release of Oxone. Disks made at 23 degrees were found to harden after a period of aging. Since dissolution of the disk is a function of hardness, it was necessary to measure the amount of available oxygen in the disk as it aged. FIG. 6 graphically illustrates the results. As will be noted, for disks made at 23 degrees, the amount of available oxygen increases with time up to 1 week, then levels off. Disks made at 23 degrees harden during the first week of aging. Disks made at 50 degrees within 24 hours and supply a constant amount of available oxygen. The results indicate that the disks made at 23 degrees and 50 degrees release available oxygen at the same rate after 1 week of aging.

A possible explanation for the differences between disks made at 23 degrees and 50 degrees centigrade is due to the rate at which the following acid-base reaction occurs:

$$2R-SO_3H(1)+Na_2CO_3(s)\rightarrow 2R-SO_3^-Na^+(s)+H_2O+CO_2(g)$$

At the lower temperature it takes about a week for the reaction to proceed to the same point as at the higher temperature after 24 hours.

It will thus be noted that the carrier composition, which comprises the reaction product of the essentially anhydrous neutralization of a linear alkyl aryl sulfonic acid by a solid neutralizing agent, appears to act not only as an anionic detergent but as a substrate that provides the slow or "timed" release of the additional active cleaning constituents, namely the organic, polycarboxylic acids and the alkaline pH functional bleaches.

Figure 7:
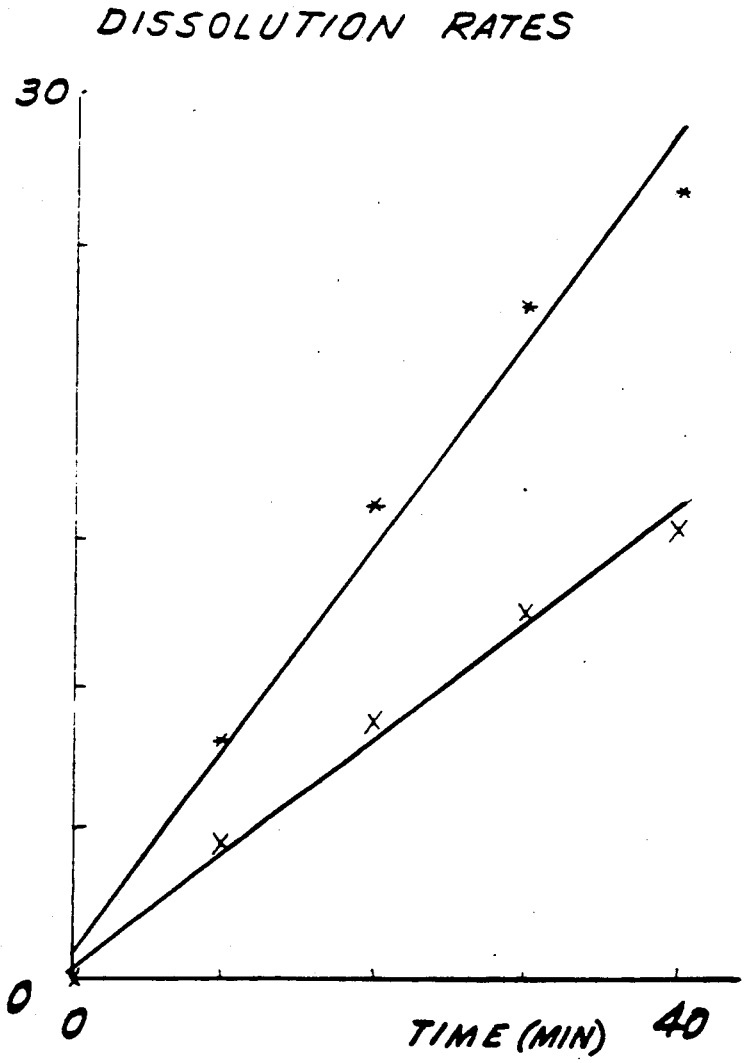
FIG. 7 is a graph illustrating the comparative dissolution rates of a preferred formulation of a solid acid detergent composition of this invention which is the reaction product of a nonaqueous neutralization reaction, and an equivalent composition which incorporates a pre-neutralized alkyl aryl sulfonate salt.

This is further illustrated by the dissolution rate comparison of FIG. 7. To compare the dissolution rates of the equivalent chemical composition, the same chemical composition was prepared in two ways. According to the first preparation method, a powder was prepared from the following:

Sodium LDBS (57%) which has been spray dried with sodium sulfate 43.2%.
Sodium carbonate 9.4%
DBA 22.3%
Sodium sulfate 24.1%

This results in the following powered composition:
Sodium LDBS 24.6%

Sodium carbonate 9.4%
DBA 22.3%
Sodium sulfate 42.7%

Secondly, the formulation of Example 8 was prepared in accordance with the process disclosed herein. Thus, the powdered composition was essentially identical to the formulation of Example 8. Four pads, two of each formula, were prepared in the manner previously discussed. A dunk tester was again employed to measure the relative dissolution rates. A pad containing 30 grams of each composition was weighed and was affixed to a bar which was then lowered into a beaker of water. Thereafter, the bar was reciprocated up and down at a rate of twenty cycles per minute, and tests on each were run at 10 minute intervals. At the end of each such interval, the pad was dried and weighed. Each curve represents the average of two trials.

As will be noted, the powdered formula utilizing the pre-neutralized sodium LDBS essentially ran out of active cleaning ingredients after 40 minutes, while the pad incorporating the solid composition of this invention had lost only about 16 of 30 grams after 40 minutes.

The pads are designed to be used by consumers who would wet them with tap water (50-75 ml), gently knead them several times to generate foam, and scrub the surface to be cleaned. After sufficient reaction time (5-10 minutes), the treated surface would be flushed with water.

The invention has been described with respect to illustrations and working examples thereof but is not to be limited to these because it is evident that one skilled in the art to which this invention pertains, with the present application before him, will be able to utilize substitutes and equivalents without departing from the invention.

What is claimed is:

1. A solid detergent composition with exhibits delayed and repeated release of active cleaning constituents, said detergent composition to be incorporated into a reusable cleaning pad, said composition comprising a) a carrier composition which comprises an anionic detergent sulfonate salt which is the reaction product of an essentially non-aqueous reaction between an anionic $C_{10}$-$C_{22}$ alkyl aryl sulfonic acid and a solid neutralizing agent wherein a partially neutralized reaction product in the form of a slurry is initially formed, which subsequently hardens into a paste; and b) an active cleaning constituent selected from the group consisting of solid dicarboxylic acids tricarboxylic acids, and mixtures thereof alkaline pH functional bleaches, wherein said cleaning constituent is added to said reaction product during the course of but prior to the conclusion of the neutralization reaction and which provides for the slow release of the active cleaning constituents and which permits multiple reuse.

2. The composition of claim 1 in which the pH is in the range of 2.5 to 5.5.

3. The composition of claim 2 in which the pH is in the range of 4.0 to 4.5.

4. The composition of claim 1 in which the pH is in the range of 7 to 11.

5. The composition of claim 4 in which the pH is in the range of 7.5-8.5.

6. The composition of claim 1 in which the aryl group is phenyl.

7. The composition of claim 6 in which the alkyl aryl sulfonic acid is linear dodecyl benzene sulfonic acid.

8. The composition of claim 1 in which the alkaline pH functional bleach is selected from the group consisting of a monopersulfate compound and trichlorocyanuric acid.

9. The composition of claim 1 in which the neutralizing agent is a solid selected from the group consisting of the salts, oxides and hydroxides of alkali and alkaline earth metals.

10. The composition of claim 9 in which the alkali metal is one selected from the group consisting of sodium and potassium; the alkaline earth metal is one selected from the group consisting of calcium and magnesium; and the salt is one selected from the group consisting of carbonates and bicarbonates.

11. The composition of claim 1 which further includes a filler material.

12. The composition of claim 11 in which the filler material is sodium sulfate.

13. The composition of claim 1 in which the dicarboxylic acid is one selected from the group consisting of glutaric, oxalic, succinic, adipic, and tartaric acids and mixtures thereof, and the tricarboxylic acid is citric acid.

14. The composition of claim 13 in which the dicarboxylic acid comprises a mixture of about 55% glutaric acid, 26% succinic acid, and 18% adipic acid.

15. The composition of claim 11 which comprises from about 12-40% by weight of the neutralized sulfonate salt; 2-30% of the neutralizing agent; 1-50% of the organic polycarboxylic acid; and 0-70% of a filler material.

16. A solid anionic detergent carrier composition which exhibits multiple release and slow release of active cleaning constituents, said carrier composition comprising the reaction product of the non-aqueous neutralization reaction between a $C_{10}$-$C_{22}$ alkyl aryl sulfonic acid and a solid neutralizing agent, said reaction product being partially neutralized and initially being in the form of a slurry and subsequently taking the form of a paste, wherein an active cleaning constituent selected from the group consisting of solid dicarboxylic acids, tricarboxylic acids, and mixtures thereof, and alkaline pH functional bleaches is added to said slurry during the course of but prior to the conclusion of the neutralization reaction.

17. The carrier composition of claim 16 in which the aryl group is phenyl.

18. The carrier composition of claim 17 in which the alkyl aryl sulfonic acid is linear dodecyl benzene sulfonic acid.

19. The carrier composition of claim 16 in which the alkaline ph functional bleach is selected from the group consisting of a monopersulfate compound and trichlorocyanuric acid.

20. The carrier composition of claim 16 in which the neutralizing agent is a solid selected from the group consisting of the salts, oxides and hydroxides of alkali and alkaline earth metals.

21. The carrier composition of claim 20 in which the alkali metal is one selected from the group consisting of sodium and potassium; the alkaline earth metal is one selected from the group consisting of calcium and magnesium; and the salt is one selected from the group consisting of carbonates and bicarbonates.

22. The carrier composition of claim 16 in which the dicarboxylic acid is one selected from the group consisting of glutaric, oxalic, succinic, adipic, and tartaric acids and mixtures thereof, and the tricarboxylic acid is citric acid.

23. The carrier composition of claim 22 in which the dicarboxylic acid comprises a mixture of about 55% glutaric acid, 26% succinic acid, and 18% adipic acid.

24. A method of manufacturing a solid anionic detergent carrier composition which exhibits multiple release and slow release of active cleaning constituents, which comprises the steps of:

a) reacting in a non-aqueous environment, a $C_{10}$–$C_{22}$ alkyl aryl sulfonic acid and a solid neutralizing agent, to initially form a partially neutralized reaction product in the form of a slurry which subsequently hardness into a paste;

b) adding to said slurry an active cleaning constituent selected from the group consisting of solid dicarboxylic acids, tricarboxylic acids and mixtures thereof and alkaline pH functional bleaches;

c) thoroughly admixing said slurry and said cleaning constituent;

d) allowing said thoroughly admixed material to dry, whereby said neutralization reaction proceeds essentially to completion and said composition hardens into a solid.

25. The method of claim 24 in which the aryl group is phenyl.

26. The method of claim 25 in which the alkyl aryl sulfonic acid is linear dodecyl benzene sulfonic acid.

27. The method of claim 24 in which the alkaline pH functional bleach is selected from the group consisting of a monopersulfate compound and trichlorocyanuric acid.

28. The method of claim 24 in which the neutralizing agent is a solid selected from the group consisting of the salts, oxides and hydroxides of alkali and alkaline earth metals.

29. The method of claim 28 in which the alkali metal is one selected from the group consisting of sodium and potassium; the alkaline earth metal is one selected from the group consisting of calcium and magnesium; and the salt is one selected from the group consisting of carbonates and bicarbonates.

30. The method of claim 24 in which the dicarboxylic acid is one selected from the group consisting of glutaric, oxalic, succinic adipic, and tartaric acids and mixtures thereof.

31. The method of claim 30 in which the dicarboxylic acid comprises a mixture of about 55% glutaric acid, 26% succinic acid, and 18% adipic acid.

* * * * *